US007850029B2

(12) United States Patent
Dreyer et al.

(10) Patent No.: US 7,850,029 B2
(45) Date of Patent: Dec. 14, 2010

(54) CLOSURE

(75) Inventors: Lino Dreyer, Rixheim (FR); Maxime Pierre Gaillot, Zaessingue (FR); Philippe Gerard Odet, St. Georges de Reneins (FR); Sebastien Cedric Widmer, Landser (FR)

(73) Assignee: Obrist Closures Switzerland GmbH, Reinach (SE)

( * ) Notice: Subject to any disclaimer, the term of this patent is extended or adjusted under 35 U.S.C. 154(b) by 928 days.

(21) Appl. No.: 10/574,090

(22) PCT Filed: Sep. 22, 2004

(86) PCT No.: PCT/EP2004/010636

§ 371 (c)(1),
(2), (4) Date: Mar. 30, 2007

(87) PCT Pub. No.: WO2005/039996

PCT Pub. Date: May 6, 2005

(65) Prior Publication Data

US 2007/0272649 A1 Nov. 29, 2007

(30) Foreign Application Priority Data

Oct. 1, 2003 (EP) ..... 03022055

(51) Int. Cl.
*B65D 41/04* (2006.01)
*B65D 53/00* (2006.01)

(52) U.S. Cl. ..... 215/344; 215/44; 215/329

(58) Field of Classification Search ..... 215/329, 215/344, 44

See application file for complete search history.

(56) References Cited

U.S. PATENT DOCUMENTS

| | | | | |
|---|---|---|---|---|
| 3,255,907 | A * | 6/1966 | Eddy | 215/329 |
| 3,286,866 | A * | 11/1966 | McIntosh | 215/329 |
| 4,489,845 | A * | 12/1984 | Aichinger et al. | 215/329 |
| 4,560,077 | A * | 12/1985 | Dutt | 215/307 |
| 5,275,287 | A * | 1/1994 | Thompson | 215/344 |
| 5,320,236 | A * | 6/1994 | Gregory | 215/344 |
| 6,325,226 | B1 | 12/2001 | Krautkramer | |
| 2002/0158037 | A1 * | 10/2002 | Kano et al. | 215/341 |
| 2004/0035818 | A1 | 2/2004 | King | |
| 2005/0247663 | A1 * | 11/2005 | Gassner | 215/344 |
| 2006/0138071 | A1 * | 6/2006 | Tsutsumi et al. | 215/252 |

FOREIGN PATENT DOCUMENTS

DE 19820266 11/1999

(Continued)

*Primary Examiner*—Anthony Stashick
*Assistant Examiner*—Madison L Wright
(74) *Attorney, Agent, or Firm*—Knoble Yoshida & Dunleavy, LLC

(57) ABSTRACT

A plastic closure for a container is provided. The closure includes a top plate with a side skirt depending from the periphery thereof. A sealing strip depends from the top plate and is adapted to sealingly engage a container neck finish. The closure also comprises an abutment member including a guide surface for guiding the sealing strip towards the neck finish as the closure is applied, to increase the strength of the seal. The guide surface includes a guide member that projects from the abutment member, thereby minimizing friction between the strip and the abutment member. The sealing strip is inclined radially towards the neck finish to improve the sealing effect.

13 Claims, 4 Drawing Sheets

FOREIGN PATENT DOCUMENTS

Figure 1:
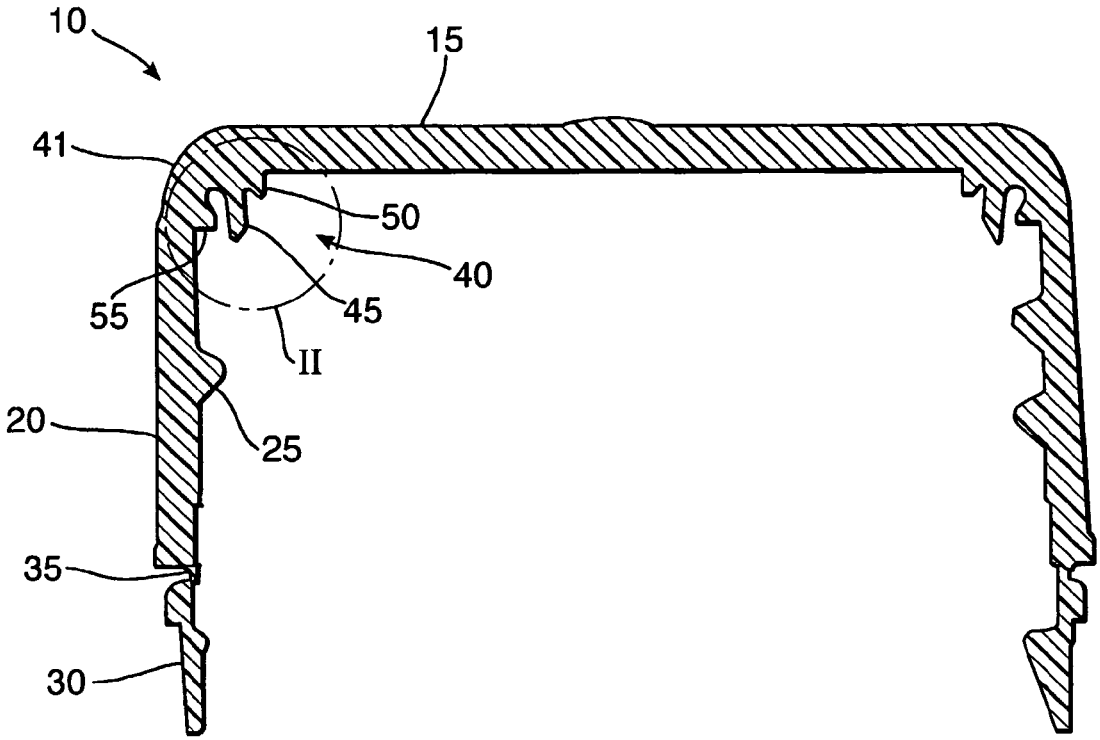

| | | |
|---|---|---|
| EP | 0529383 | 8/1992 |
| EP | 0 529 383 A2 | 3/2003 |
| JP | 10203551 | 8/1998 |
| WO | 96/26121 | 8/1996 |
| WO | 00/23342 | 4/2000 |
| WO | 2004/031045 | 4/2004 |

* cited by examiner

CLOSURE

The present invention relates generally to a plastics closure for a container and more specifically to a closure with a sealing arrangement for sealing against the container.

The present invention is therefore particularly suitable for sealing the pressure generated in a container by carbonated beverages and the like.

A particularly effective system for providing a seal involves the use of a thin and flexible sealing strip which depends from the inner surface of a closure top plate. For example, U.S. Pat. No. 4,623,070 describes a closure with an annular flexible sealing strip depending from its top plate. The sealing strip is inclined radially outwardly and positioned so that when the closure cap is threaded onto a container the container neck finish contacts the sealing strip. As the closure cap is threaded progressively further onto the container the sealing strip bends around the outside radius of the neck finish to form a side seal and along the top surface of the neck finish to form a top seal. The position adopted by the sealing strip is determined by an annular abutment member positioned at the point of intersection between the closure top plate and the closure sidewall. The sealing strip is sandwiched between the annular abutment member and the container neck finish with the result that the sealing strip wraps around the container neck finish to provide a gas-tight seal. This type of seal can be used as an outer seal i.e. sealing on the outer surface of the neck finish as in the case of U.S. Pat. No. 7,623,070; or the seal can serve as an inner seal, for example in the case of U.S. Pat. No. 3,255,907. In each case the abutment member serves as a guide surface to force the sealing strip to adopt a position on the neck finish in which the strength of the seal is improved.

Documents U.S. Pat. No. 4,560,077 and EP 0 114 127 describe sealing systems in which both inner and outer sealing strips are provided. In each case both of the sealing strips have associated abutment members which cause the sealing strip to wrap more closely around the container neck finish to provide a good seal.

The problem with these known systems results from the fact that as the abutment member guides the sealing strip around the neck finish there is a relative sliding motion between the two. As the sealing strip slides with respect to the abutment member frictional forces will be generated. These friction forces will tend to increase the torque necessary for application and removal of the closure. EP 0 114 127 also describes the use of thin ribs projecting directly from its top plate and sidewall for use as guide surfaces. However, because the ribs are thin and project directly from the sidewall or top plate the ribs are flexible and will be deformed by the sealing strip itself, this will create an increased area of contact between the two, again increasing frictional forces.

The present invention provides a plastics closure for a container, the closure comprising a top plate, a side skirt depending from the periphery of the top plate, a sealing strip depending from the top plate and adapted to sealingly engage the side of the container neck finish, and an abutment member including a guide surface for guiding the sealing strip towards the neck finish as the closure is applied to increase the strength of the seal and to minimize friction between the strip and the abutment member, wherein the sealing strip is inclined towards the neck finish and thus improve the sealing effect.

The present invention therefore provides an abutment member, but the abutment member includes a specific projection which functions as a guide surface, rather than using the entire abutment member. Because the guide member is provided as part of an abutment member the structure of the closure and the guide surface projected directly from the top plate or side skirt of the closure.

The present invention allows for a guide surface in which the contact area on the sealing strip is minimized to minimize friction. By minimizing friction the torque required to apply and remove the closure is reduced. In addition, because the closure is likely to be used in conjunction with carbonated beverages, it is likely that the closure top plate will dome under the over-pressure generated. When the closure top plate domes the sealing strip will be forced to move relative to the container neck finish. By including a sealing system with lower friction, the sealing strip can move to a new sealing position more easily.

By including an abutment member, particular advantages can be gained if the member is positioned at the intersection between the sidewall and the top plate because the intersection will be strengthened. This could have particular benefits where the closure domes.

The sealing strip is inclined towards the neck finish. In this way the sealing strip is already biased towards the neck finish so that a more effective seal can be provided.

The sealing strip may taper slightly away from the top plate. This has the advantage that the closure can be removed from the mould during the manufacture process. Further, it eases the capping process as it allows the sealing strip to slide more easily over and/or around the neck finish of the container.

The inner surface of the free end of the sealing strip may taper sharply. This sharp taper helps to prevent damage, caused by misalignment, to the sealing strip during capping. Such damage may tend to increase the torque required during un-capping.

The guide member may comprise a curved guide surface. Because the guide surface is curved the contact area on the sealing strip can be further reduced.

The guide member may be adapted to compress the sealing strip against the neck finish when the closure is applied so that the strength of the seal is increased further. The sealing strip is typically compressed against the side of the neck finish by the guide member.

The abutment member may further comprise a curved sidewall portion which provides a clearance region between the sealing strip and the abutment member. This means that in the region of the curved sidewall the sealing strip is not contacted by the abutment member or forced against the container neck finish so that, whilst a strong seal is provided, the frictional forces which must be overcome to break the seal are reduced.

The sealing strip may be adapted to seal on the outside surface of the neck finish so that the sealing strip is a so-called outer seal.

In addition to a sealing strip which seals on the outside surface of the neck finish the closure may further comprise a so-called plug seal or olive seal arrangement which is adapted to seal on the inner surface of the neck finish. The plug seal may be arranged so that it exerts an outward force on the neck finish to cause the neck finish to move outwards. This outward movement of the neck finish can be used to increase the strength of the seal provided by the outer sealing strip.

The sealing strip may alternatively be adapted to seal on the inner surface of the neck finish. In this case, the sealing strip would replace the above mentioned plug or olive seal.

Of course both inner and outer sealing strips and respective abutment members with guide surfaces may be provided on the same closure.

The present invention also provides a container with a neck finish in combination with a closure as described hereinabove.

Figure 3:
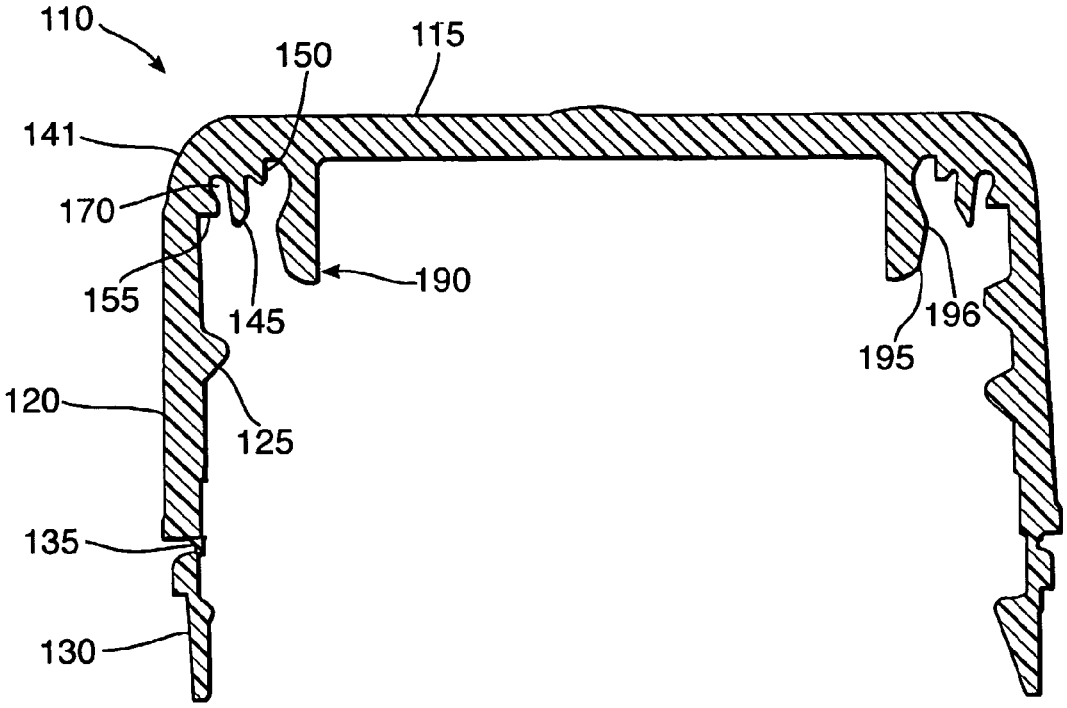
Figure 4A:
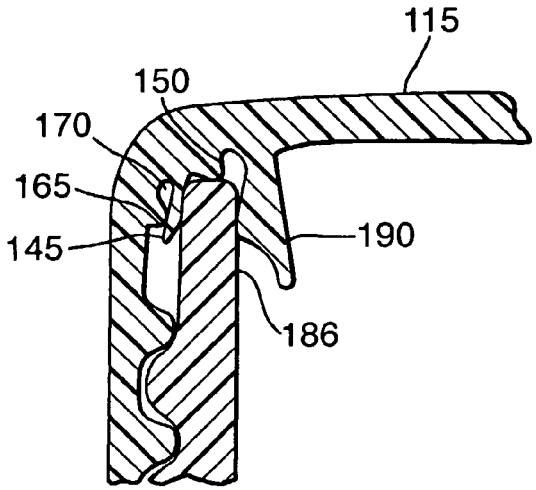
Figure 4B:
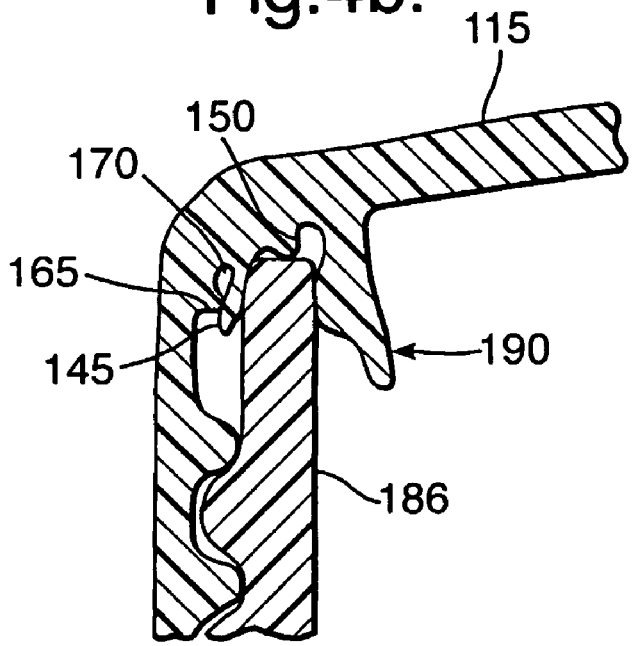
Figure 4C:
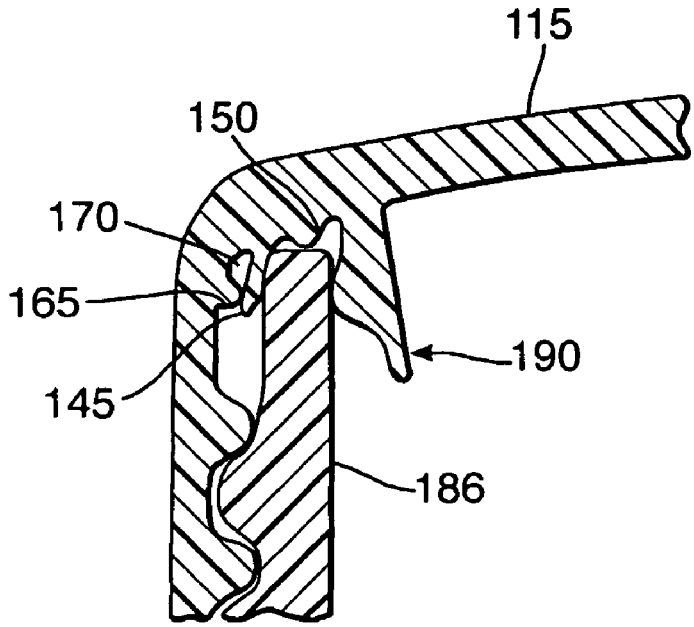

The present invention will now be more particularly described, by way of example, with reference to the accompanying drawings, in which:

FIG. 1 is a section of a plastics closure with a sealing arrangement formed according to a first embodiment of the present invention;

FIGS. 2*a* to 2*f* are a sequence of enlarged sections of the sealing arrangement of FIG. 1 showing the arrangement sealing against a container neck finish;

FIG. 3 is a section of a plastics closure with a sealing arrangement formed according to an alternative embodiment of the present invention; and FIGS. 4*a* to 4*c* are a sequence of enlarged sections of the sections of the sealing arrangement of FIG. 1 showing the effect of an over-pressure in an associated container.

Referring first to FIG. 1 there is shown a plastics closure generally indicated 10. The closure 10 comprises a disc-shape top plate 15 and a cylindrical side skirt 20 depending from the periphery of the top plate 15. The side skirt 20 includes internal screw threads 25 for engaging corresponding external screw threads on a container neck finish (not shown). A tamper-evident band 30 is frangibly connected to the lower, open end of the side skirt 20 by bridges 35 in an arrangement that will be well known tot hose skilled in the art. The closure 10 further comprises a sealing arrangement generally indicated 40 and located in the region of the curved intersection 41 between the top plate 15 and the side skirt 20.

Figure 2A:
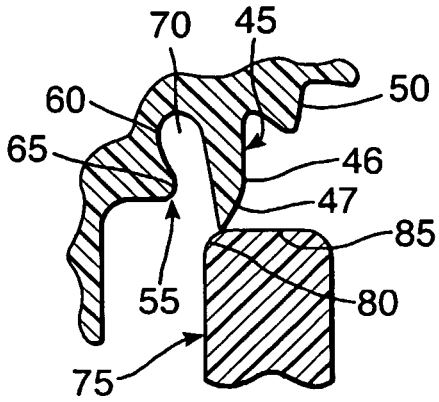
Figure 2B:
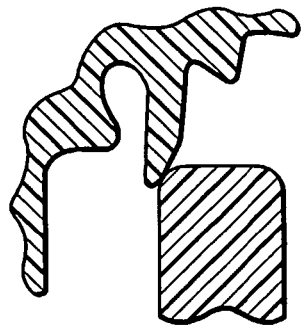
Figure 2C:
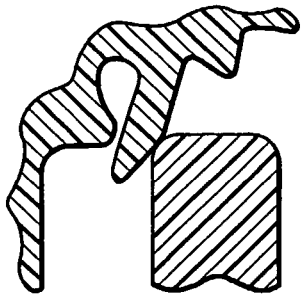

Referring now also to FIG. 2*a* showing an enlarged view of the arrangement circled in FIG. 1, the sealing arrangement 40 comprises a sealing strip 45, a top seal 50 and an abutment member 55. The sealing strip 45, in this embodiment, is designed for sealing around the outside of the rim of a container.

The sealing strip tapers slightly away and depends from the top plate 15. This taper may be uniform or could vary from the end of the sealing strip 45 adjacent the top plate to the tip. The strip 45 is inclined radially inward, in this embodiment by about 12° from a vertical axis through the centre of the top plate 15, although other angles are contemplated. At the free end of the strip 45 the inner surface 46 tapers sharply and radially outward to form a slope 47.

In an alternative embodiment in which the sealing strip seals on the inside of the neck finish, the sealing strip 45 will be inclined radially outward. Further, the slope 47 will be found on the opposite surface (i.e. the radially outer surface).

The top seal 50 is positioned radially inward of the seal strip 45 and comprises a generally triangular projection depending from the top plate 15.

The abutment member 55 is located at the intersection 41 and is reminiscent of a 'pressure block' sealing element, as will be well known to those skilled in the art. The abutment member 55 includes a curved sidewall 60 which itself extends from the upper end of the seal strip 45. The opposite end of the sidewall 60 defines a generally C-shape interspace 70, or clearance, between the abutment member 55 and the sealing strip 45.

Figure 2D:
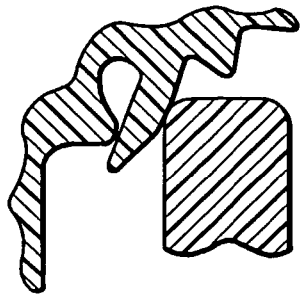
Figure 2E:
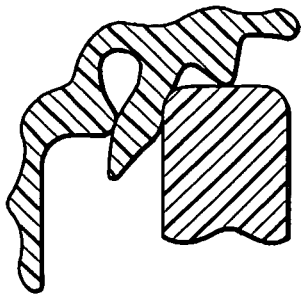
Figure 2F:
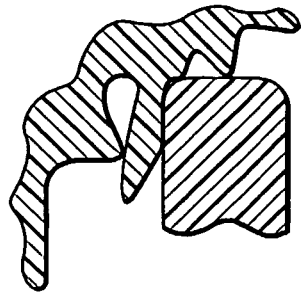

Referring no to FIGS. 2*a* and 2*f* the operation of the sealing arrangement 40 will be described. For clarity, only FIG. 2*a* has been labeled. The parts of FIGS. 2*b* to 2*f* are identical to FIG. 2*a* with only their relative positioning being different.

In FIG. 2*a* the closure 10 has been placed on top of a container neck finish 75 ready to be screwed on. As the closure 10 is screwed on, the slope 47 of the sealing strip 45 contacts the curved upper outside surface 80 of the neck finish 75 and begins to slide past it, as shown progressively in FIGS. 2*b* and 2*c*. Due to the relative position of the strip 45 and the surface 80, as the strip 45 slides past the surface 80 it is deflected radially outwardly.

When the strip 45 reaches the position shown in FIG. 2*d* the outer surface of the strip 45 contacts the curved guide surface 65 of the abutment member 55 only. The guide surface 65 prevents further outwards deflection of the sealing strip and guides the strip 45 towards the neck finish, so that it begins to wrap around the finish, as shown in FIG. 2*e*. As the strip 45 wraps around the finish 75 it slides relative to the guide surface 65.

At the point shown in FIG. 2*e* the top seal 50 contacts the upper surface 85 of the neck finish 75 and begins to deform. The top seal 50 deformation causes an increase in the torque required to turn the closure, eventually preventing further turning (without breakage), at the position shown in FIG. 2*f*. In addition to applying a seal, therefore, the top seal 50 helps to act as a depth stop whilst the closure 10 is being screwed on.

In the fully screwed-on position the sealing strip 45 is only contacted on the abutment member 55 by the guide surface 65, due to the curved sidewall 60 and the resulting projecting position of the surface 65, together with the clearance 70. Accordingly, whilst the seal is improved by the guide surface 65, the sealing strip 45 is only held against the neck finish by contact with a small area on the guide surface 65. This means that when the closure is unscrewed the removal torque is not unnecessarily large i.e. the seal is improved but is limited.

Referring now to FIG. 3 there is shown an alternative embodiment. The closure 110 includes a sealing arrangement which is identical to that shown in FIGS. 1 and 2, except that there is an additional inner plug seal 190 is out of the well-known 'olive seal' type in which the outer surface 195 includes a curved projection 196 for engaging the inner surface 186 of the neck finish.

FIGS. 4*a* to 4*c* show the advantageous operation of the sealing arrangement once the closure 110 has been fully screwed on to the neck finish. Because the closure 110 is intended for use with carbonated beverages, the internal pressure in the container acting on the closure will increase over time. This results in doming of the top plate 115, as shown progressively in FIGS. 4*a* to 4*c*. As the top plate 115 domes the plate 115 is effectively splayed apart from the sidewall 120 and the top plate pivots upwards. The result is that the sealing strip 145 is pulled upwards with respect to the guide surface 165. Because the friction between the sealing strip 145 and the guide surface 165 is minimized the sealing strip is allowed to move with respect to the neck finish in such a way that it can easily find a new sealing position. Because the strip 145 still contacts the guide surface 165 it is still pushed towards the finish so that the seal is still strong. In addition, because the clearance 170 is curved it is maintained throughout doming, so that even with the top plate fully domed the strip 145 is not compressed by the abutment member 155 except perhaps by the projection. This means that even during doming the removal torque is still reduced due to the clearance 170.

The invention claimed is:

1. A plastics closure for a container, the closure comprising a top plate, a side skirt depending from a periphery of the top plate, a sealing strip depending from the top plate and adapted to sealingly engage the side of a container neck finish, and an abutment member including a projecting guide member for guiding the sealing strip towards the neck finish as the closure is applied, so that a strength of the seal is increased, wherein the guide member contacts the sealing strip over a relatively small area so that a friction between the sealing strip and the abutment member is minimized and wherein the sealing strip is inclined radially towards the neck finish for improving the sealing effect.

2. A closure according to claim 1, wherein the sealing strip tapers slightly away from the top plate.

3. A closure according to claim 1, wherein the surface of a free end of the sealing strip tapers sharply.

4. A closure according to claim 1, wherein the sealing strip is adapted to seal on an outer surface of the neck finish.

5. A closure according to claim 4, wherein the closure further comprises a plug seal adapted to seal on an inner surface of the neck finish.

6. A closure according to claim 5, wherein the plug seal is adapted to exert an outward force on the neck finish for causing the neck finish to move outwards, thereby increasing the strength of the seal from the sealing strip.

7. A container with a neck finish in combination with a closure according to claim 1.

8. A container with a neck finish in combination with a closure according to claim 2.

9. A container with a neck finish in combination with a closure according to claim 3.

10. A container with a neck finish in combination with a closure according to claim 4.

11. A container with a neck finish in combination with a closure according to claim 5.

12. A container with a neck finish in combination with a closure according to claim 6.

13. A plastics closure for a container, the closure comprising:

a top plate, a side skirt depending from a periphery of the top plate, a sealing strip depending from the top plate and adapted to sealingly engage the side of a container neck finish, and an abutment member including a guide member projecting towards the sealing strip for guiding the sealing strip towards the neck finish as the closure is applied, so that a strength of the seal is increased, wherein the guide member contacts the sealing strip over a relatively small area so that a friction between the sealing strip and the abutment member is minimized and wherein the sealing strip is inclined radially towards the neck finish for improving the sealing effect.

* * * * *